United States Patent [19]

Roberts et al.

[11] 3,946,240

[45] Mar. 23, 1976

[54] ENERGETIC ELECTRON BEAM ASSISTED FUSION NEUTRON GENERATOR

[75] Inventors: Thomas G. Roberts; Romas A. Shatas; Harry C. Meyer, III; John D. Stettler, all of Huntsville, Ala.

[73] Assignee: The United States of America as represented by the Secretary of the Army, Washington, D.C.

[22] Filed: Apr. 4, 1974

[21] Appl. No.: 457,941

[52] U.S. Cl. ..... 250/493; 250/501

[51] Int. Cl.[2] ..... G21G 4/02

[58] Field of Search ..... 250/492, 493, 499, 500, 250/501, 502; 313/61 S

[56] References Cited

UNITED STATES PATENTS

| | | | |
|---|---|---|---|
| 3,526,575 | 9/1970 | Bennett | 250/500 |
| 3,746,860 | 7/1973 | Shatas | 250/493 |
| 3,748,475 | 7/1973 | Shatas | 250/502 |
| 3,766,004 | 10/1973 | Roberts | 250/502 |
| 3,864,640 | 2/1975 | Bennett | 250/500 |

*Primary Examiner*—Craig E. Church

*Attorney, Agent, or Firm*—Nathan Edelberg; Robert P. Gibson; James T. Deaton

[57] ABSTRACT

An energetic electron beam fusion neutron generator in which a plasma is produced by a plasma generator to produce neutrons and to increase the number of neutrons produced, an electron source is guided to the produced plasma to further heat the plasma and produce an even greater number of neutrons. The inner electrode of the plasma generator utilizes the innerraction of the beams self magnetic field with the inner surface of the inner electrode to guide the electron source to the plasma.

6 Claims, 1 Drawing Figure

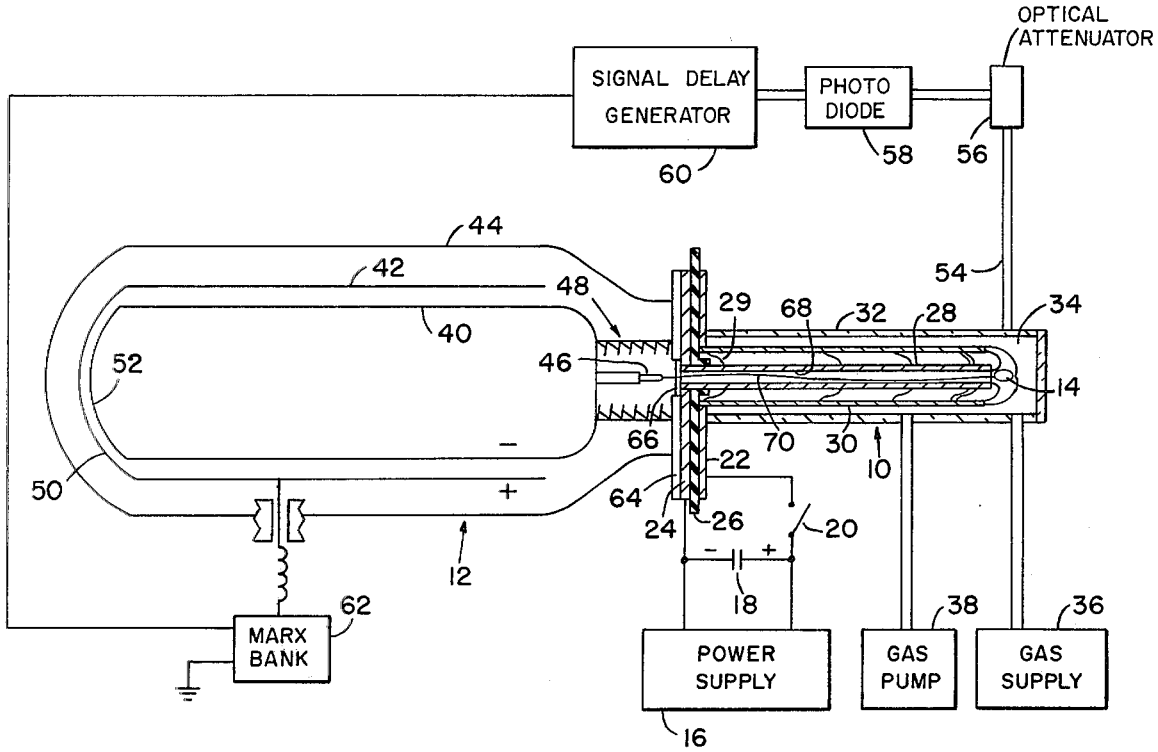
OPTICAL ATTENUATOR
SIGNAL DELAY GENERATOR
PHOTO DIODE
60
58
56
44
42
48
40
54
29
68
32
28
34
52
46
14
66
70
30
10
22
50
64
24
26
20
12
18
62
MARX BANK
POWER SUPPLY
GAS PUMP
GAS SUPPLY
38
36
16

ENERGETIC ELECTRON BEAM ASSISTED FUSION NEUTRON GENERATOR

BACKGROUND OF THE INVENTION

Until recently pulses of neutrons could be obtained from plasma generators like those developed in research on controlled thermonuclear devices, from pulsed fission reaction, and from laser created plasma where a high energy pulse of laser radiation is used to heat a target of solid deuterium. It is now also feasible to use pulsed laser radiation to heat the plasma of generators like the coaxial plasma gun to obtain intense pulses in excess of $10^{11}$ neutrons per burst such as disclosed in U.S. Pat. No. 3,766,004. However, it should be pointed out that any method which heats the plasma during a very short time (nanoseconds) produces the same results, and the most intense pulses of neutrons which are obtained from the fission reactors are very expensive and produce radioactive waste.

Absorption of some of the energy of an electron beam by a plasma would increase its temperature and thereby increase the number of neutrons produced by the plasma. When the plasma temperature is increased the neutron production goes up by the ratio of $\overline{\sigma v}$ at the final temperature to $\overline{\sigma v}$ at the initial temperature. Here $\overline{\sigma v}$ is the product of the relative velocity $v$ and the reaction cross section $\sigma$ averaged over the velocity distribution of the nuclei. For the conditions produced in the plasma gun, doubling the temperature can cause an order of magnitude increase in the neutron yield.

Therefore, it is an object of this invention to provide a neutron generator in which the energies from an electron source and a plasma generator are combined to produce neutrons.

Another object of this invention is to provide a neutron generator in which electrons from an electron beam source are guided and focused onto a hot plasma produced by a plasma generator.

Still another object of this invention is to provide a device in which the magnetic fields are such that they not only focus the electrons from the electron source but also affect their orbits near the plasma volume so that they spend much more time in this volume and both effects can greatly increase the total inneraction and the amount of energy transferred to the plasma.

SUMMARY OF THE INVENTION

A fusion neutron generator in which an internal source of high energy electrons such as from a modern flash x-ray machine is operated in the electron beam mode and a plasma generator such as a coaxial plasma gun arranged and operated so that the high energy electron beam is focused onto and retained near the volume where the high density plasma is produced by having the electron beam source guided to the high density plasma by the inner electrode of the plasma generator. The timing of the transmission of the high energy electron beam to the plasma is accomplished by use of photocontrol means to determine when the plasma has reached the desired volume and when the high energy electron beam will reach the desired volume.

BRIEF DESCRIPTION OF THE DRAWING

In the drawing:

The single FIGURE is a diagrammatic view partially in section of a fusion neutron generator according to this invention.

DESCRIPTION OF THE PREFERRED EMBODIMENT

Referring now to the drawing, the apparatus according to this invention includes a plasma generator 10 and an electron beam source 12. Plasma generator 10 and electron beam source 12 are axially aligned for concentrating their energies in a plasma volume 14 such as illustrated. Power supply 16 is provided for plasma generator 10 and the electrical system thereof includes a condenser bank 18 and starting switch 20 that are connected to inner conductor 22 and outer conductor 24. Inner and outer conductors 22 and 24 are separated by an insulator 26 and outer conductor 24 is connected to the negative side of capacitor bank 18 while inner conductor 22 is connected to the positive side. Outer conductor 24 is electrically connected to inner electrode 28 of the plasma gun portion of plasma generator 10 and inner conductor 22 is connected to outer electrode 30 of the plasma gun. An outer housing 32 generally made of glass encloses the plasma gun to form a chamber 34 therein. A gas pump 38 is connected into housing 32 for evacuating chamber 34 and gas supply 36 is connected to housing 32 for supplying gases to chamber 34. The gases in chamber 34 are preferrably deuteriumtritium but may also be deuterium, tritium or deuterium and $^3$He.

Electron source 12 consists of an internal source of high energy electrons such as a modern flash x-ray machine operated in the electron beam mode, and as illustrated includes three coaxial cylinders 40, 42, and 44. Inner cylinder 40 is connected to high voltage terminal 46 of discharge tube 48. Rounded end 50 of intermediate cylinder 42 is close to rounded end 52 of inner cylinder 40. Outer cylinder 44 forms the wall of the cylindrical tank of the electron source which is filled with oil or an insulating gas everywhere except in the discharge tube. It is to be understood that other electron producing sources than that illustrated can be used in this invention.

Control means for electron energy source 12 includes operationally connected light pipe 54, optical attenuation 56, photo-diode 58, signal delay generator 60, and Marx bank 62 that is conventionally connected to electron energy source 12 as illustrated. Marx bank 62 as illustrated contains its own power supply and the Marx bank is normally charged being in condition for discharge upon the appropriate signal from signal delay generator 60. Plasma generator 10 and electron beam source 12 are interconnected structurally through plate 64 which contains window 66. Plate 64 and window 66 seal plasma generator 10 and electron beam source 12 fluidly relative to each other and closes chamber 34 of plasma generator 10. Window 66 is made of conventional material that will pass electrons therethrough.

In operation, the device is prepared by first having chamber 34 of plasma generator 10 filled with the appropriate gases to be used. As illustrated, power supply 16 has charged its condenser bank 18 and Marx bank 62 has been charged and made ready for firing. The device is now ready for operation by closing switch 20. The closing of switch 20 causes the voltage of condenser bank 18 to appear across the electrodes of the coaxial dense plasma focus gun and the gases in the coaxial plasma generator break down near insulator 28 forming current sheath 29. Current sheath 29 then propagates between the outer electrode 30 and inner electrode 28 and is driven by the magnetic pressure of its own magnetic field. The discharge becomes more intense as the sheath propagates. When current sheath 29 reaches the end of electrodes 28 and 30, it folds back on itself and rapidly collapses the plasma toward the axis of plasma generator 10 as in a Z-pinch. This produces hot plasma volume 14 where electron or ion number density may be as high as $10^{19}$ $cm^{-3}$, the temperature may be as high as several times $10^{7°}$ Kelvin and the confining magnetic fields of the order of megagauss. At this time and for a period of the order of a microsecond, neutrons are produced. The velocity of the propagation of current sheath 29 and therefore the time of collapse of the plasma toward the axis is a function of the voltage on condenser bank 18. As current sheath 29 is propagating between electrodes 28, 30 light is produced that increases in intensity and the light is detected by light pipe 54 which carries the detected light to photo-diode 58 after having passed through optical attenuator 56. Optical attenuator 56 is preset so that accidential changes in the light intensity will not cause signal delay generator 60 to begin to operate until current sheath 29 has reached a predetermined location along the plasma generator. Light pipe 54 and photo-diode 58 are used partially to insure that noise does not start signal delay generator 60 to function to soon. The signal which starts signal delay generator 60 is delayed a preset amount and is then used to erect Marx bank 62 of electron source 12 to cause high energy electrons to enter bore 68 of inner electrode 28 through thin window 66 from electrode 46. Once the high energy electrons find themselves in the space of bore 68, their space charge is neutralized and they are guided by the inneraction of their own magnetic field with the inner surface of electrode 28. Consequently, they form a beam 70 which is guided by the inneraction of its magnetic field with electrode 28 to dense plasma 14. The inneraction of the magnetic fields with electrode 28 does not cause the electron beam 70 to maintain a path in a generally straight line, but the magnetic fields guide the beam such that the beam does not touch the inner surface of bore 68. As can be seen, the high magnetic fields of the plasma focus device about the end of electrode 28 are arranged so that the high energy electrons from electrode 46 are focused onto the plasma volume which contains the high temperature, high density plasma. Thus, heating this plasma to even higher temperatures, and also causing the volume to constrict even more which also raises the temperature of plasma 14. In this manner, the neutron yield from fusion reactions is substantially increased.

In order to operate the neutron generator again, one must first change the gases in plasma generator 10 by utilizing gas pump 38 and gas supply 36, and by recharging condenser bank 18 and Marx bank 62. It may also be necessary from time to time to replace window 66.

In the production of neutrons, great care must be taken to insure that the plasma in plasma generator 10 is clean (free of high Z material) and that no high Z material is carried in with the electron beam. This is accomplished in this invention by using the inneraction of the beams own magnetic field with electrode 28 to pick up and form the intense high energy electron beam from electron beam source 12. The magnetic field configuration about electrode 28 is such that the beam is not retained in bore 68 but rather is focused onto hot dense plasma 14.

We claim:

1. An electron beam assisted fusion neutron generator comprising a plasma generator for producing a plasma, a source of high energy electrons, said plasma generator and said source of high energy electrons being mounted coaxially for transmission of electrons from said source of high energy electrons and propagation of said electrons through a bore within an inner electrode of said plasma generator, a chamber in said plasma generator that is filled with gases selected from the group consisting of deuterium-tritium, deuterium, tritium and deuterium $^3He$ to provide a clean environment for said plasma, and control means for said plasma generator and said source of high energy electrons for causing neutrons to be produced from direct inneraction of the plasma produced by the plasma generator and said electrons from said source of high energy electrons, said control means being such as to cause said electrons to have their space charge neutralized when they enter said bore and to be guided by inneraction of their magnetic field with an inner surface of said bore to deliver said electrons to said plasma.

2. An electron beam assisted fusion neutron generator as set forth in claim 1, wherein said control means for the plasma generator and the source of high energy electrons includes control circuitry for the plasma generator including a power supply connected to a capacitor bank and means connecting the capacitor bank through a control switch to electrodes of the plasma generator including said inner electrode.

3. An electron beam assisted fusion neutron generator as set forth in claim 2, wherein said inner electrode is connected to the negative side of said capacitor bank.

4. An electron beam assisted fusion neutron generator as set forth in claim 2, wherein said control means for said source of high energy electrons includes means responsive to a predetermined light condition established in the plasma generator upon firing of the plasma generator to cause said source of high energy electrons to be emitted.

5. An electron beam assisted fusion neutron generator as set forth in claim 4, wherein said plasma generator and said source of high energy electrons are joined through a plate that has a window therein that allows electrons from said electron source to pass therethrough and into said bore of said inner electrode.

6. An electron beam assisted fusion neutron generator as set forth in claim 4, wherein said gases are deuterium-tritium.

* * * * *